US006675789B2

(12) United States Patent
Pearce, III et al.

(10) Patent No.: US 6,675,789 B2
(45) Date of Patent: Jan. 13, 2004

(54) CONTROL AGENT DELIVERY SYSTEM

(75) Inventors: Robert Clarence Pearce, III, Arlington, TX (US); Dale Vilmer Kiplinger, Carollton, TX (US)

(73) Assignee: NCH Corporation, Irving, TX (US)

( * ) Notice: Subject to any disclaimer, the term of this patent is extended or adjusted under 35 U.S.C. 154(b) by 0 days.

(21) Appl. No.: 09/930,661

(22) Filed: Aug. 15, 2001

(65) Prior Publication Data

US 2001/0054367 A1 Dec. 27, 2001

(51) Int. Cl.[7] ..... F41B 11/00; F42B 12/46

(52) U.S. Cl. ..... 124/56; 43/132.1; 102/502; 102/370

(58) Field of Search ..... 102/502, 512, 102/513, 370; 43/132.1; 124/56

(56) References Cited

U.S. PATENT DOCUMENTS

| | | | | |
|---|---|---|---|---|
| 954,591 A | | 4/1910 | Rogers | |
| 1,611,533 A | | 12/1926 | Kirsten | |
| 2,028,217 A | | 1/1936 | Huffman | 102/12 |
| 3,340,645 A | | 9/1967 | Poteet | 43/84 |
| 3,564,705 A | | 2/1971 | Cochardt | 29/596 |
| 3,791,303 A | * | 2/1974 | Sweeney et al. | 102/502 |
| 3,894,492 A | | 7/1975 | Barr et al. | 102/93 |
| 3,901,158 A | | 8/1975 | Ferb | 102/92 |
| 3,921,614 A | * | 11/1975 | Fogelgren | 124/75 |
| 3,951,070 A | | 4/1976 | Flatau et al. | 102/92.4 |
| 4,476,515 A | | 10/1984 | Coffee | 361/226 |
| 4,756,118 A | | 7/1988 | Evans, II | 43/132.1 |
| 4,839,985 A | | 6/1989 | Barry | 43/132.1 |
| 5,009,164 A | | 4/1991 | Grinberg | 102/502 |
| 5,035,183 A | | 7/1991 | Luxton | 102/502 |
| 5,058,312 A | | 10/1991 | Jackson | 43/124 |
| 5,101,763 A | * | 4/1992 | Creason et al. | 118/683 |
| 5,174,807 A | * | 12/1992 | MacDonald | 504/206 |
| 5,254,379 A | | 10/1993 | Kotsiopoulos et al. | 428/35.7 |
| 5,353,712 A | | 10/1994 | Olson | 102/513 |
| 5,361,533 A | | 11/1994 | Pepper | 43/124 |
| 5,393,054 A | | 2/1995 | Rouffer | 273/58 |
| 5,639,526 A | | 6/1997 | Kotsiopoulos et al. | 473/577 |
| 5,750,467 A | * | 5/1998 | Shasha et al. | 504/206 |
| 5,775,026 A | | 7/1998 | Pearce et al. | 43/132.1 |
| 5,783,516 A | * | 7/1998 | Magin et al. | 504/206 |
| 5,936,190 A | * | 8/1999 | Buzick | 102/502 |
| 6,145,441 A | | 11/2000 | Woodall et al. | 102/502 |
| 6,223,658 B1 | * | 5/2001 | Rosa et al. | 102/501 |
| 6,306,913 B1 | * | 10/2001 | Hayes et al. | 514/689 |
| 6,393,992 B1 | * | 5/2002 | Vasel et al. | 102/502 |
| 2002/0179075 A1 | * | 12/2002 | Robinson et al. | 124/56 |

FOREIGN PATENT DOCUMENTS

| | | | | |
|---|---|---|---|---|
| CA | 2325197 A1 | * | 6/2001 | A01M/1/20 |
| EP | 1163846 A2 | * | 12/2001 | A01M/1/00 |

* cited by examiner

*Primary Examiner*—Charles T. Jordan
*Assistant Examiner*—John W. Zerr
(74) *Attorney, Agent, or Firm*—Locke Liddell & Sapp LLP; Monty L. Rose

(57) ABSTRACT

A control agent delivery system useful for dispersing a pesticide, herbicide, fungicide or other biocide around a target or target area that is not directly accessible or that is hazardous to the user. The system includes a separable, two-part projectile containing a control agent disposed in a powder, liquid or gel dispersal medium, together with a gas-propelled, projectile launching device. A method of use of the subject system that causes the projectile to perform differently, depending upon the manner of launch, is also disclosed.

21 Claims, 3 Drawing Sheets

CONTROL AGENT DELIVERY SYSTEM

BACKGROUND OF THE INVENTION

1. Field of the Invention

This invention relates to a system that is useful for delivering a liquid, gel or powder containing a control agent to a target or target area that is hazardous or generally inaccessible, and for dispersing the control agent around the target or within the target area. More particularly, the invention relates to a system including a projectile, preferably a biodegradable, two-part capsule containing predetermined quantities of a dispersible control agent such as a pesticide, herbicide, biocide or fungicide in liquid, powder or gel form, in combination with a gas-propelled, projectile launching device. Another aspect of the invention relates to a method of use of the subject system that causes the projectile to separate differently, depending upon the orientation of the projectile relative to the direction of travel when launched.

2. Description of Related Art

Control agents such as pesticides, herbicides, biocides and fungicides are typically applied using sprayer-type applicators or aerosol propellants. When using such devices, the active ingredient, often diluted by water or another solvent, is propelled toward a target area through a spray nozzle that typically has a range of less than about 15 feet. Difficulties are often encountered, however, in using such apparatus and methods to apply control agents to targets that are outside that range, that are located high above ground or floor level, or that are situated in otherwise hazardous locations. When sprayer devices are used to apply a pesticide to the nests or hives of swarming insects, it has been observed that the disturbed insects can follow the stream of pesticide back to its source, thereby subjecting the user to a greater likelihood of suffering painful stings and dangerous allergic reactions.

Injection devices suitable for use in extermination applications are disclosed in U.S. Pat. Nos. 3,564,705; 5,058,312 and 5,361,533.

A spring powered injection device for use in trapping animals is disclosed in U.S. Pat. No. 3,340,645.

Projectiles propelled by munitions or compressed gas for use in riot control are disclosed in U.S. Pat. No. 3,791,303; 3,894,492; 3,901,158; 3,951,070; 5,009,164; and 5,035,183.

Projectiles designed for paint ball applications are disclosed in U.S. Pat. Nos. 5,254,379; 5,353,712; 5,393,054 and 5,639,526. Such projectiles are typically sufficiently durable to withstand launching without releasing the contents but will shatter or rupture upon impact with a person or object. Paint ball projectiles can be made with rigid, semi-rigid or flexible shells and can be made using materials such as linear polymers, gelatin, moldable starch and water mixtures, for example, that are substantially impervious to the substance contained inside the shell. Where polymers are used in making the shells, a photodegradable additive can be incorporated into the polymer for environmental purposes. Various structural features and manufacturing techniques can be used in making the paint ball projectiles to affect the manner in which the projectiles burst or shatter upon impact. These include scoring, etching, dimpling and otherwise varying the wall thickness of the projectiles. Substances disclosed in the foregoing patents as being deliverable through the use of such "paint ball" type projectiles include water, glycerin, glycol, paints, dyes and other coloring agents, weighting agents, starch, vegetable oil, mineral oil, smoke and tear gas.

Additional prior art patents identified during prosecution of a prior related application are U.S. Pat. Nos. 954,591; 1,611,533; 2,028,217; 4,476,515; 4,756,118; 4,839,985; 5,775,026; and 6,145,441.

U.S. Pat. Nos. 954,591 and 2,028,217 disclose explosive projectiles containing insecticide compositions. U.S. Pat. No. 1,611,533 discloses a shooting device for discharging a bead or shot of liquid insecticide. U.S. Pat. No. 4,476,515 discloses an electrostatic sprayer for pesticides. U.S. Pat. No. 4,756,118 discloses a fire ant eradication device useful for injecting vaporized liquid containing an insecticide. U.S. Pat. No. 4,839,985 discloses a nest exterminating kit including a spring-launched projectile formed with a flexible outer wall and a relatively rigid base portion which encapsulates a liquid chemical, the projectile having an air space provided to enhance the explosive effect of the chemical as the projectile impacts a desired target. U.S. Pat. No. 5,775,026 discloses an insect bait and control station.

U.S. Pat. No. 6,145,441 discloses a frangible payload-dispensing projectile having a dimpled spherical capsule filled with a dispersible fill material. The spherical capsule can be made from hydrophilic colloidal materials or from synthetic organic compounds, including olefinic polymers, and can contain a fill material such s powder, particles, microcapsules, etc., mixed with a high specific gravity material.

SUMMARY OF THE INVENTION

Control agents such as pesticides, herbicides and fungicides are often needed in places that are inaccessible or difficult or dangerous to reach. Such potential use sites can include, for example, commercial buildings, warehouses, attics, barns, trees, cooling towers, and the like.

According to the present invention, a control agent delivery system is disclosed for use in safely applying substances such as pesticides, herbicides, fungicides and other biocides to targets situated in areas that are not directly accessible or that are potentially hazardous to the user.

According to a preferred embodiment of the invention, a control agent delivery system is disclosed that comprises a projectile and a projectile launching device. The projectile preferably contains a substance selected from the group consisting of liquids, gels and powders, the substance comprising at least one control agent selected from the group consisting of pesticides, herbicides and fungicides. The projectile can be selectively positioned by the user prior to launch so as to cause the projectile to release the substance containing the control agent either shortly after leaving the barrel of the projectile launching device or upon impact with a more distant target, as desired.

According to another preferred embodiment of the invention, a projectile is disclosed that comprises an elongated, generally cylindrical, hollow body made of naturally occurring gelatin or dried animal protein, the body further comprising opposed, slidably engageable male and female sections, each section having one convex, most preferably hemispherical, closed end and one generally circular, open end, the body containing a liquid, gel or powder substance comprising at least one control agent selected from the group consisting of pesticides, herbicides, fungicides or other biocides.

According to another preferred embodiment of the invention, an apparatus is disclosed that comprises a projectile launching device, preferably utilizing a compressed gas source such as, for example, air, nitrogen or carbon dioxide, but most preferably carbon dioxide, as a propellant, in combination with the projectile of the invention. According to one particularly preferred embodiment of the invention, the projectile launching device and projectile are cooperatively sized and configured in such manner that they are not usable in conventional firearms or in commercially available paint ball systems.

According to another preferred embodiment of the invention, a method is disclosed for applying a control agent to a close-range target area. The method comprises the steps of providing a projectile as disclosed herein that contains a substance, most preferably diatomaceous earth or another similarly satisfactory material, that functions as a carrier for a control agent such as a pesticide, herbicide, fungicide or other biocide; loading the projectile into a projectile launching device with the projectile oriented so that the closed end of the female portion of the projectile is forwardly facing; directing the projectile launching device toward a target area; and actuating the projectile launching device to launch the projectile toward the target area. With the projectile oriented in this manner, propelling gasses from the projectile launching device cause the projectile to fracture into a plurality of smaller pieces within a relatively short time and distance after exiting the barrel of the device for reasons discussed in greater detail below. As a result, the substance containing the control agent is dispersed and distributed over an elongated target zone extending from about three to about 30 feet from the end of the barrel, with the broadest and most concentrated coverage occurring about 15 feet from the end of the barrel. Beneficial results are also achieved when a projectile oriented in the close-range position impacts a solid object shortly after exiting the barrel of the projectile launching device, in which case the projectile will fracture upon impact, causing dispersion of the substance containing the control agent into a cloud surrounding the point of impact.

According to another preferred embodiment of the invention, a method is disclosed for impacting a solid target, such as a wasp nest, at a range of up to about 30 feet or more from a projectile launching device and for dispersing a control agent in a zone or area around the target. The method preferably comprises the steps of providing a projectile as disclosed herein containing a carrier material or diluent, most preferably diatomaceous earth, and further comprising a control agent such as a pesticide, herbicide, biocide or fungicide; loading the projectile into a projectile launching device with the projectile oriented so that the closed end of the male portion of the projectile is forwardly facing, directing the projectile launching device toward a target, and actuating the projectile launching device to launch the projectile toward the target. With the projectile oriented in this manner, it will desirably continue along a trajectory dictated by ballistic factors such as its launch velocity, cross-sectional area and geometry, air resistance and the physical state of the contained substance, until such time as the projectile impacts the target. Impact with the target, or with another solid object proximal to the target, desirably fractures or shatters the projectile, causing the control agent to disperse and thereby creating a cloud of the control agent around the target. Most preferably, where the target is a solid object such as a wasp or other insect nest, the projectile will contact the target with sufficient force to actually disengage it from its support or point of attachment to a structure and cause it to fall, while simultaneously coating both the nest and insects located on or near the nest with the control agent. Even where the nest is not contacted directly by the projectile, any "near-miss" that causes the projectile to impact another nearby solid object should likewise produce a cloud of the control agent in the vicinity of the nest.

If desired, color coding or other indicia can be provided to help the user readily distinguish between the male and female ends of the projectile, thereby facilitating loading of the projectile into the projectile launching device in such manner as to produce the intended dispersion effect. This can be done, for example, by providing identical projectiles for use in both methods of the invention, with adequate instructions informing the user as to which end should be forwardly directed for a particular application, or by providing differently marked capsules for the different applications, again with adequate instructions regarding which to use and how to load for each method of application.

According to another preferred embodiment of the invention, a method is disclosed for contacting or treating fauna or flora, especially pests, fungi and the like, situated in hard-to-reach or otherwise hazardous locations with a control agent through the use of a projectile as disclosed herein propelled by a gas-powered launching device from a remote location toward the intended use site.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
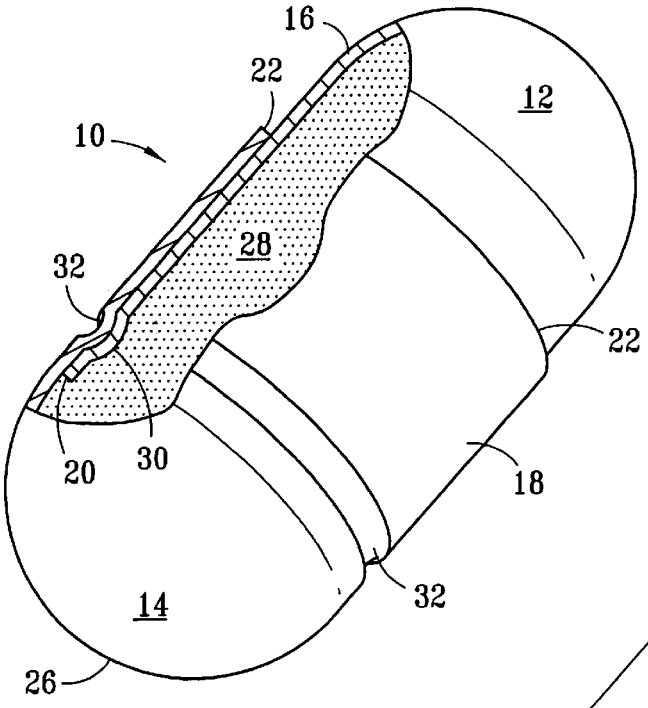
FIG. 1 is a an enlarged perspective view, partially broken away and partially in section, that exaggerates for illustrative purposes principal structural elements of a preferred projectile of the invention.
Figure 2:
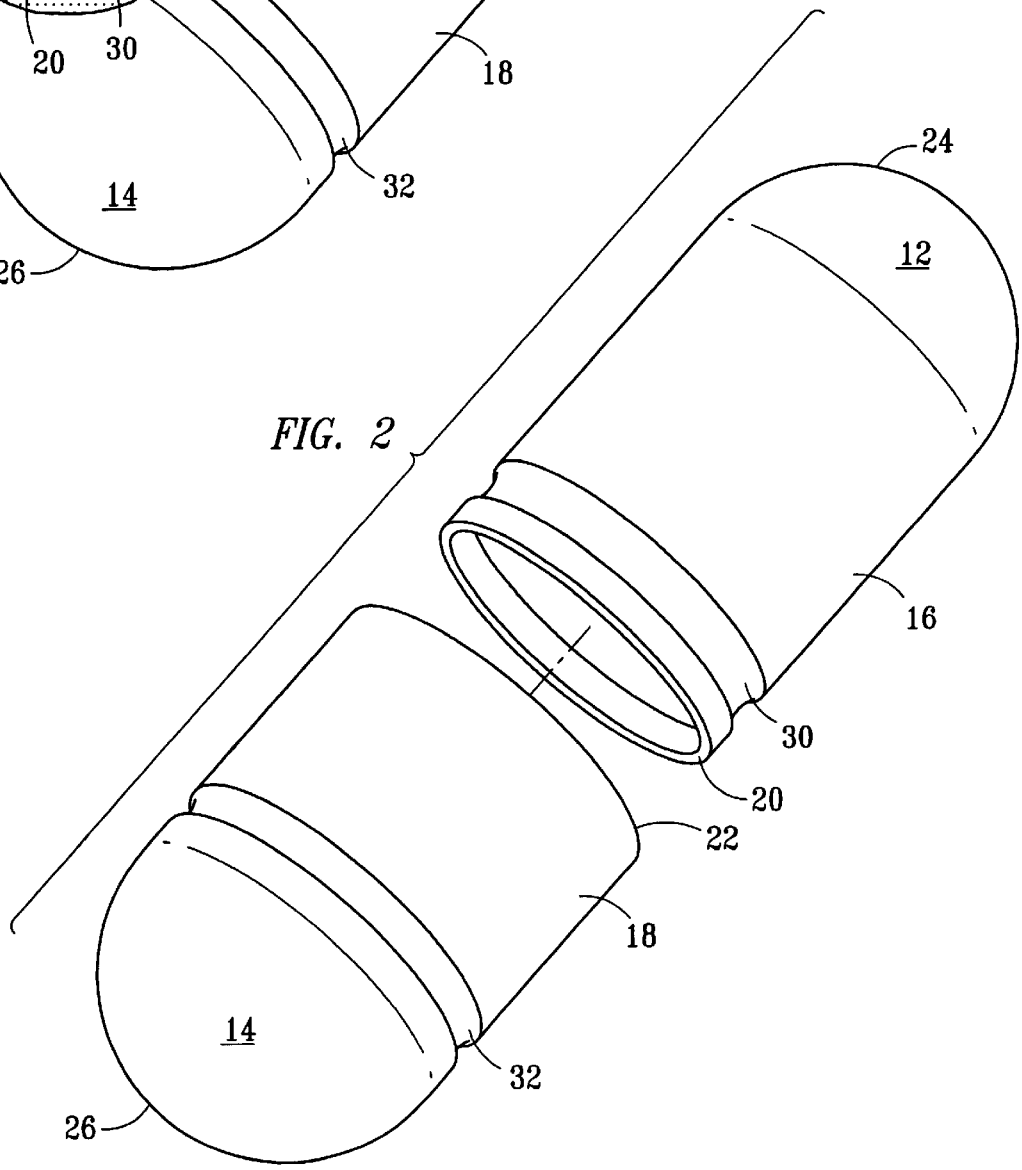
FIG. 2 is a longitudinally exploded perspective view of the capsule portion of the projectile of FIG. 1, without the substance containing the control agent.

Referring to FIGS. 1 and 2, projectile 10 preferably comprises two opposed and slidably engageable sections, including male body section 12 and female cap section 14. The physical configuration is similar to that of commercially available double blind (DB) capsules, although the moisture content is preferably within defined ranges as described below. Each section 12, 14 preferably has a cylindrical sidewall section 16, 18; one convex, preferably hemispherical, closed end 24, 26; and one open end preferably defined by substantially circular edge 20, 22, respectively. Projectiles 10 having substantially flatter ends can exhibit a more erratic flight path. Cap section 12 is desirably slightly longer and more slender than cap section 14. When assembled as shown in FIG. 1, with a substance comprising a control agent 28, preferably selected from the group consisting of a pesticide, herbicide or fungicide, disposed inside projectile 10, edge 20 of body section 12 preferably slides inwardly of edge 22 of cap section 14 so that a portion of the outside surface of sidewall section 16 is closely adjacent to a portion of the inwardly facing surface of sidewall section 18. Referring again to FIGS. 1–2, body section 12 preferably further comprises an annular groove 30 that cooperates with annular detent 32 of cap section 14 so that the body and cap sections can be snapped into frictional engagement in the position shown in FIG. 1 to produce projectile 10. Control agent 28 is preferably loaded into projectile 10 prior to assembly of body and cap sections 12, 14, although commercially available injection systems can also be used, particularly with liquid or gel carriers, to fill projectile 10 after assembly of body and cap sections 12, 14.

Body and cap sections 12, 14 of projectile 10 are preferably made of a destructively deformable material such as dried animal protein, most preferably in the form of a natural gelatin. Controlling the moisture content of the gelatin within desired ranges is believed to be significant for achieving optimal results with the invention. Gelatin capsules of the type frequently used for pharmaceutical applications typically have moisture contents ranging from about 20 to about 30 weight percent by weight of the capsule and not including the weight of the contained medicament. However, for reasons discussed in greater detail below in relation to the system and method of the invention, body and cap sections 12, 14 having a moisture content ranging from about 5 to about 20 weight percent, and most preferably from about 5 to about 15 weight percent, at the time of use are preferred. Projectiles 10 wherein the body and cap sections 12, 14 have moisture contents greater than about 20 weight percent tend to deform rather than fracture or shatter as desired during use. Conversely, projectiles 10 wherein the body and cap sections 12, 14 have moisture contents less than about 5 weight percent can fracture or shatter prematurely. According to one particularly preferred embodiment of the invention, projectile 10 is made with body and cap sections 12, 14 having a moisture content ranging from about 15 to about 18 weight percent. When projectile 10 is filled with a dry powdered or granular substance as discussed below, some moisture will migrate from the gelatin into the powder, thereby reducing the moisture content of the gelatin to, for example, about 10 weight percent. Depending upon conditions of storage and the elapsed time between manufacturing and use, the moisture content can be further affected by the ambient temperature and humidity to further decrease or, in some cases increase, the moisture content of the gelatin. Most preferably, the moisture content of the gelatin in body and cap sections 12, 14 will be about 10 weight percent±about 5 weight percent at the time of use. Commercially available desiccants or humectants can be provided in or with projectiles 10 where needed to provide suitable moisture contents at the time of use. Where the substance containing control agent 28 is a liquid or gel, non-aqueous carriers are preferred to prevent moisture from migrating into the walls of body and cap sections 12, 14. Alternatively, it can be preferable to coat the inside walls of body and cap sections 12, 14 with a hydrophobic material to prevent moisture migration in such cases.

In addition to natural gelatin, other similarly effective materials, particularly grafted starch and some polymeric materials, can also be used in making body and cap sections 12, 14 of projectile 10, provided that such materials are capable of carrying control agent 28, are tough enough to withstand launching, and are also brittle enough to destructively deform or shatter upon impact with an object. Generally speaking, materials used in making body and cap sections 12, 14 of projectiles 10 will be in a near-crystalline state rather than in an amorphous state at the time of use so as to promote fracturing or shattering during use in accordance with the methods of the invention. Additives that promote photodegradation or biodegradation of the polymer following use can also be included in the formulations used to make body and cap sections 12, 14 where desired. The use of colorants or other visible indicia in or on at least one of body and cap sections 12, 14 can also help the user readily distinguish between the body and cap sections 12, 14 of projectile 10 when loading projectile 10 into the projectile launching device for use in practicing the method of the invention as described below.

Particularly preferred control agents 28 for use in the invention include pesticides, herbicides and fungicides at concentrations consistent with those used in conventional applicators. It will also be understood and appreciated upon reading this disclosure that other control agents such as antimicrobial agents, algaecides, animal control agents, spill control agents and the like can also be used within the system and method of the invention, and that dosage rates can vary depending upon the intended application and upon the size and nature of the target or target area. Examples of pesticides that can be utilized as control agents in the present invention include pyrethrin, piperonyl butoxide, permethrin, chlorpyrifos, propoxur, bacillus thuringiensis, hydromethylnon, fipronil and other similarly effective compounds. Examples of herbicides that can be utilized as control agents in the present invention include bromacil, dicamba, glyphosate and other similarly effective compounds. Examples of fungicides that can be utilized as control agents in the present invention include benomyl, cyproconazole, imazalil and other similarly effective compounds.

Control agent 28 is preferably provided in combination with a carrier substance that can be in liquid, solid or gel form, and if a solid, is preferably a finely divided powder or granular material. In producing projectiles 10, the inert carrier material, filler or diluent can be used to increase the weight or volume of material inside the projectile as desired. Where the carrier substance is a powder or granular solid, control agent 28 is preferably coated or adsorbed onto the surface of the carrier particles in such manner that control agent 28 retains its efficacy as an active ingredient. Preferred carrier materials for particular systems can comprise, for example, diatomaceous earth, which is preferred, fumed silica, corn starch, talc, ground walnut shells, and the like. Where the carrier material is a liquid or gel, for example a glycol, control agent 28 is desirably soluble or miscible in the carrier. When using a liquid carrier, a truer flight path for projectile 10 is achieved by minimizing any unfilled space inside projectile 10 and by incorporating a dispersible, finely divided, particulate material such as an inert powder into the liquid. Other components such as pest attractants, including for example, feed attractants and pheromones, can also be included together with control agent 28 inside projectile 10 if desired.

Figure 3:
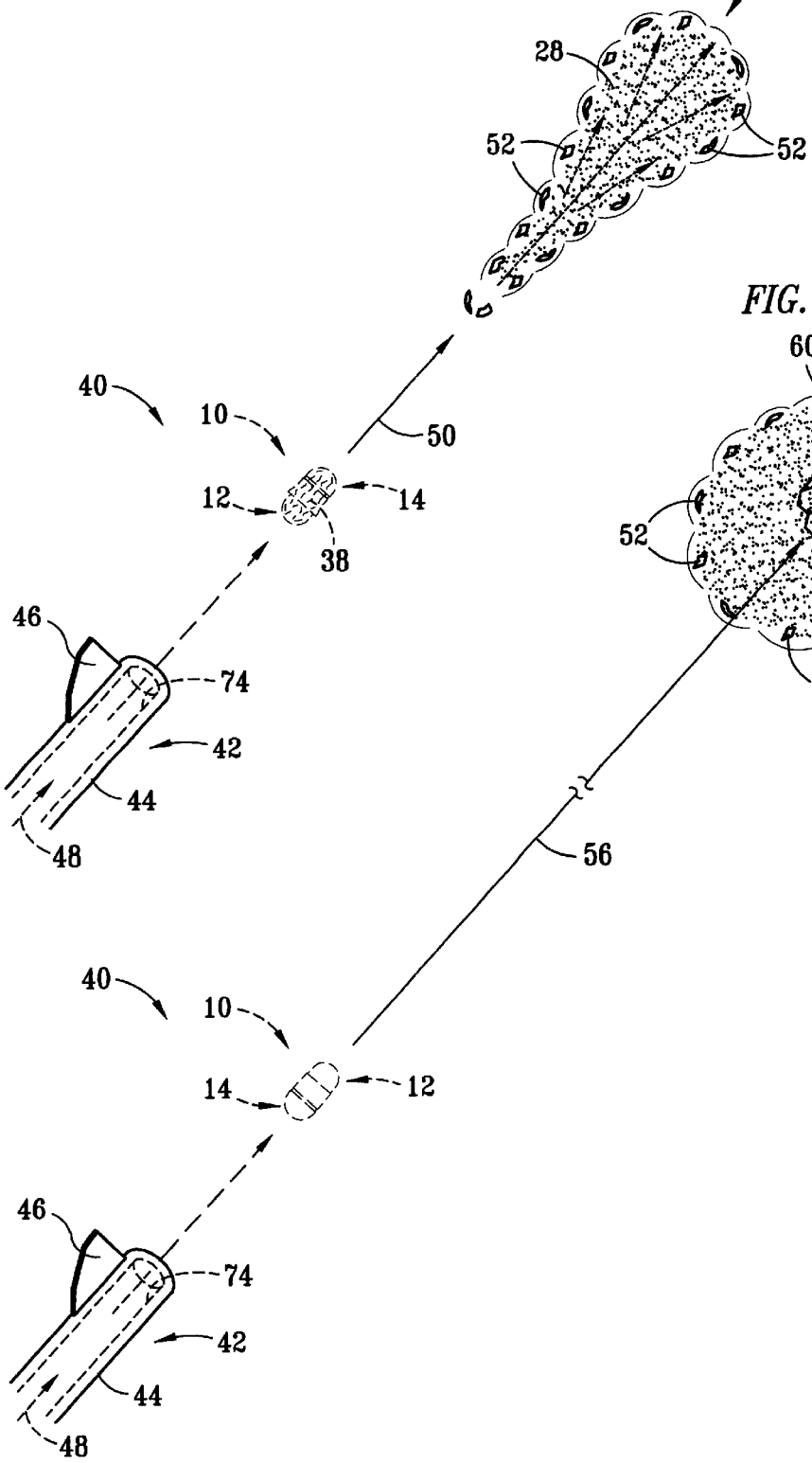
FIG. 3 is a simplified perspective view of the control agent delivery system of the invention being used according to one preferred embodiment of the inventive method, wherein the projectile fractures shortly after exiting the barrel of the projectile launching device.
Figure 4:
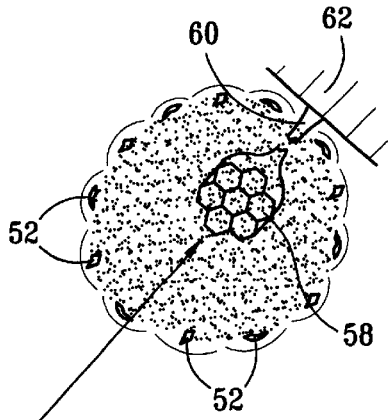
FIG. 4 is a simplified perspective view of the control agent delivery system of the invention being used according to another preferred embodiment of the inventive method, wherein the projectile impacts an insect nest suspended from an overhead support located approximately thirty feet from the barrel of the projectile launching device.

Referring to FIGS. 3 and 4, control agent delivery system 40 of the invention preferably comprises projectile 10, as described above, in combination with projectile launching device 42. Projectile launching device 42 can have any one of many different configurations such as, for example, a simulated rifle or pistol, or any other similarly effective apparatus having a launch tube or barrel with an elongated bore 44 and a source of pressurized gas 48 that can be activated to propel projectile 10 from the bore at an acceptable velocity and trajectory. The diameter of bore 44 is preferably slightly greater than the outside diameter of cap portion 14 of projectile 10 to reduce the tendency of propelling gas 48 to blow past projectile 10 during launch. In FIGS. 3 and 4, projectile launching device 42, partially broken away, is configured similarly to the muzzle of a conventional gas-operated pistol that, when actuated, directs the pressurized, propelling gas 48 through bore 44, which is preferably smooth. Projectile launching device 42 is also desirably equipped with a sighting device 46 to assist a user in aiming projectile 10 toward a target. Propelling gas stream 48, preferably carbon dioxide, nitrogen or air, and most preferably carbon dioxide, is discharged from a pressurized gas source that is controlled by conventional means so a gas pulse of desired duration is released and directed against projectile 10 inside bore 44 when projectile launching device 42 is triggered or otherwise activated by a user. Preferred sources of pressurized gas for use as propelling gas stream 48 include pre-packaged cartridges or canisters that are lightweight and yet contain a sufficient quantity of compressed gas to launch a series of projectiles 10 at an acceptable velocity without resupply.

Projectile launching device 42 is preferably easily maneuverable so as to facilitate variation or adjustment of the launch direction and trajectory by the user. FIG. 3 depicts projectile 10 being propelled in the direction shown by arrow 50 toward a target zone or area 54 that is proximal to projectile launching device 42 in accordance with one embodiment of the inventive method. FIG. 4 depicts projectile 10 being propelled toward a more distal target 58 in accordance with another embodiment of the inventive method.

Figure 5:
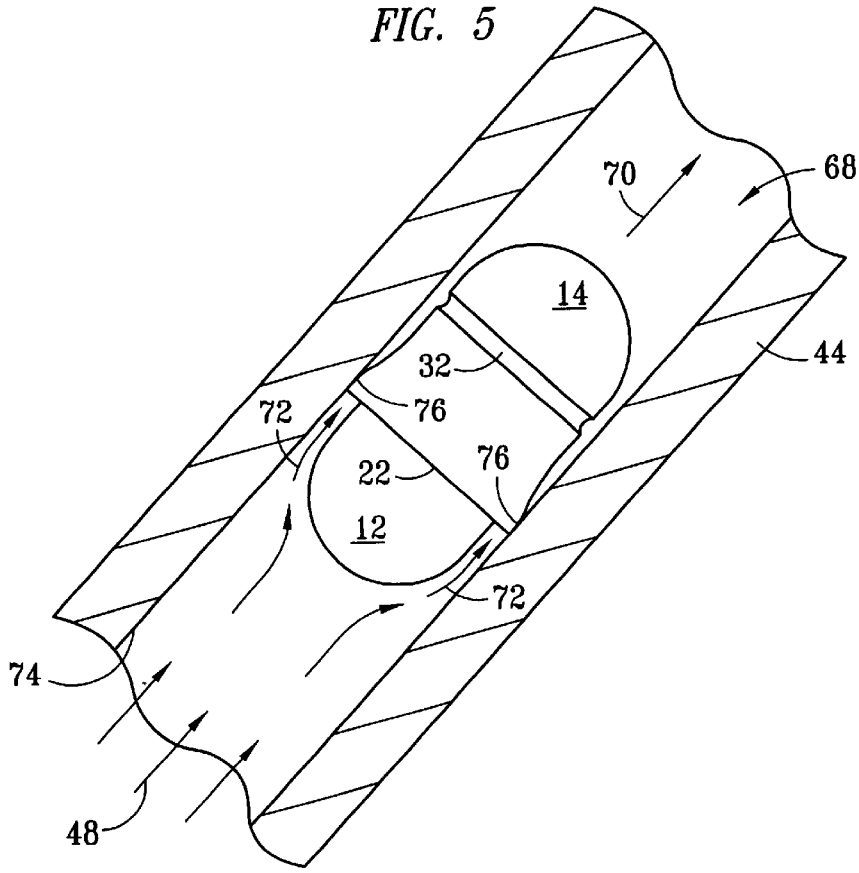
FIG. 5 is a enlarged detail view, partially in section, illustrating a preferred projectile of the invention when oriented according to the method shown and described in relation to FIG. 3 as the projectile travels through the barrel of the projectile launching device, and depicting the manner in which the propelling gas acts on the projectile while inside the barrel.

Referring to FIGS. 3 and 5, whenever control agent delivery system 40 is intended for use in delivering a control agent 28 as previously described to a target area 54 that extends over a greater area than would typically be associated with a specific target, such as an insect nest, projectile 10 is selectively loaded into projectile launching device 42 with the closed end of cap section 14 facing toward the target. Projectile launching device 42 is most preferably positioned approximately 15 feet from the center of the target area prior to launching projectile 10. When propelling gas stream 48, most preferably carbon dioxide, is released from a pressurized gas source connected to projectile launching device 42, projectile 10 is forced out the barrel toward target area 54. As the projectile travels through bore 68 of barrel 44, propelling gas stream 48 flows around the closed end of body section 12, as shown by stream lines 72, and beneath edge 22 of cap section 14. This causes edge 22 to flare outwardly against sidewall 74 of bore 68, providing an annular seal 76 against sidewall 74 as the projectile travels down barrel 44 in the direction shown by arrow 70 in FIG. 5. The frictional engagement between body section 12 and cap section 14 at annular detent 32, in cooperation with the confined space for radial expansion that is afforded by sidewall 74 of bore 68, prevents the sections from separating before exiting the barrel. If the material used in making sections 12, 14 contains less than about five weight percent moisture, the walls of sections 12, 14 can shatter inside barrel 44, causing propelling gas stream 48 to actually blow through the projectile and out the barrel, scattering the control agent in a cloud around the user rather than in the desired target zone 54 as shown in FIG. 3. Desirably, projectile 10 will exhibit fractures 38 upon exiting barrel 44, followed by complete shattering into fragments 52 at a distance of about 1 to 5 feet, and most preferably about 3 feet, after exiting the barrel. Where the moisture content of body and cap sections 12, 14, respectively, ranges between about five and about 15 weight percent moisture, projectile 10 will typically shatter as depicted diagrammatically in FIG. 3, and control agent 28 will disperse in a plume or pattern extending up to about 30 feet from the projectile launching device, with the widest spread and heaviest concentration of control agent 28 falling approximately 15 to 18 feet from projectile launching device 42. Where the moisture content of projectile 10 exceeds about 20 weight percent, projectile 10 may simply deform and not achieve the desired dispersion of control agent 28.

Figure 6:
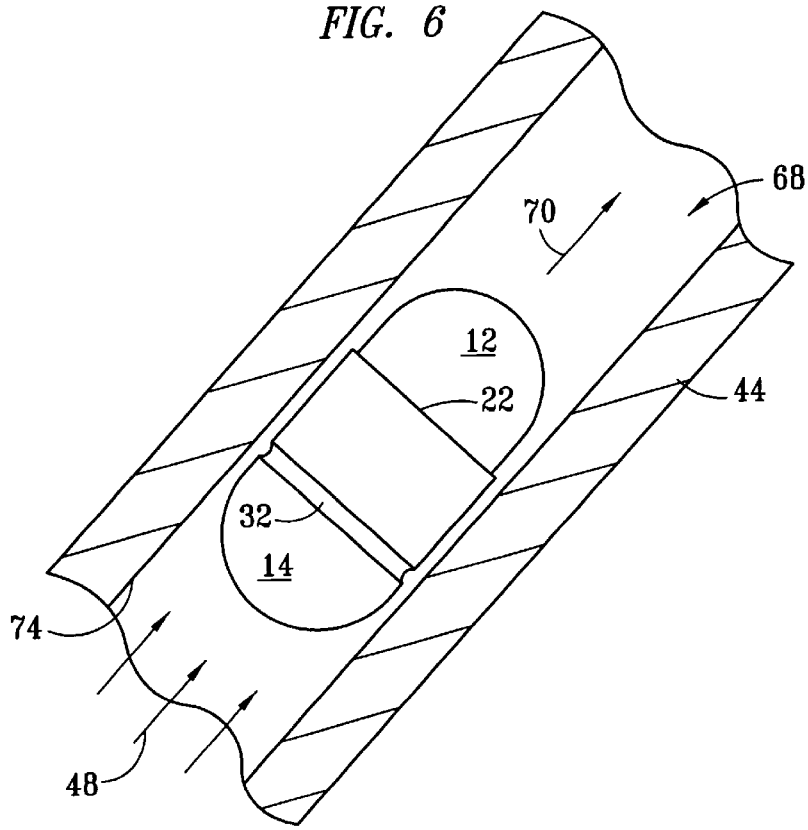
FIG. 6 is a enlarged detail view, partially in section, illustrating a preferred projectile of the invention when oriented according to the method shown and described in relation to FIG. 4 as the projectile travels through the barrel of the projectile launching device, and depicting the manner in which the propelling gas acts on the projectile while inside the barrel.

Referring to FIGS. 4 and 6, whenever control agent delivery system 40 is intended for use in delivering a control agent 28 as previously described to a specific target such as insect nest 58, projectile 10 is selectively loaded into projectile launching device 42 with the closed end of body section 12 facing toward the target. When propelling gas stream 48, most preferably carbon dioxide, is released from a pressurized gas source connected to projectile launching device 42, projectile 10 is forced through and out of barrel 44 toward target 58. It should be appreciated that the annular gap between the outside of cap section 14 and sidewall 74 of bore 68 inside barrel 44 is exaggerated for illustrative purposes in FIG. 6. As the projectile travels through bore 68 of barrel 44 in the direction shown by arrow 70, propelling gas stream 48 causes the projectile to gain sufficient speed to reach a target 58 up to about 30 feet away from projectile launching device 42. Although the trajectory is depicted as a straight line 56 in FIG. 4, where control agent 28 is provided with a dry particulate carrier material, it is likely that the flight path of projectile 10 will approximate a helical spiral of expanding diameter as projectile 10 travels from projectile launching device 42 to a target 58 disposed about 30 feet away. Most preferably, the diameter of the helical spiral will not exceed about 18 to 24 inches over a distance of about 30 feet. If the material used in making sections 12, 14 contains from about 5 to about 15 weight percent moisture, projectile 10 will not shatter during flight but will preferably shatter into fragments 52 upon impact with target 58 or another solid object situated nearby, causing control agent 28 to disperse in a cloud surrounding the target. Projectile 10 will desirably have sufficient force upon impact to detach a nest such as target 58 from its point of attachment 60 to support member 62 as shown. Where the moisture content of projectile 10 is greater than about 20 weight percent, projectile 10 is unlikely to fracture and shatter upon impact with a solid object.

It should be understood that the trajectories and distances as disclosed herein, although based on actual tests, are approximate and are dependent upon many interrelated factors including without limitation the force and duration of the propelling gas stream, the length and diameter of the bore of the projectile launching device, the weight and dimensions, including wall thickness, of the projectile, the nature and moisture content of the material used in making the projectile, the physical state and density of the material contained inside the projectile, the angular positions of the barrel and target, atmospheric conditions, and the like.

Nevertheless, applicants have learned, and it is now apparent from this disclosure, that significantly different beneficial results are achievable through use of like projectiles and the same projectile launching device in the control agent delivery system of the invention dependent upon whether the projectile is loaded with the body or cap section facing the target or target area. Target zones such as an area over which a control agent is to be scattered or dispersed are best covered when the projectile is loaded with the female section forward. Conversely, more distant, specific targets are best treated by loading the projectile with the male end forwardly facing. When using this mode or embodiment of practicing the invention, hazardous targets such as insect nests can be reached and treated while the user remains a safe distance away. Target distances as great as up to about 45 feet from the projectile launching device may be reachable practicing this embodiment of the invention under some circumstances, although aiming accuracy may be reduced substantially at distances over about 30 feet, and aiming distances ranging from about 25 to about 30 feet are preferred.

Projectiles 10 as disclosed herein are most preferably made with a length of about 0.67 inches and a diameter of about 0.38 inches. If desired, however, both the length and diameter can vary, provided that ratio of length to diameter is controlled within a range of about 1.58 to about 1.94. This slightly elongated, tubular shape is believed to promote separation and/or shattering of projectile 10 upon impact with a solid object. Projectiles 10 having a higher length-to-diameter ratio can tend to wobble during flight, and more spherical projectiles having a lower ratio can be more prone to veering off in one direction from the aiming point during flight. If desired for safety or other reasons, the caliber of projectile 10 and barrel 44 of projectile launching device 42 can be selected so as to avoid interchangeability with conventional ammunition, paint balls or riot-control projectiles. The filled weight of projectiles 10 made according to the invention is preferably greater than about 0.35 grams, and preferably ranges between about 0.5 and about 1 gram per capsule. Filled weights greater than about 1 gram can increase the likelihood of unintentional glass breakage during use.

Projectiles 10 as disclosed herein can be safely used around building windows without fear of breakage when propelled from projectile launching device 42 by conventional $CO_2$ cartridges of the type used, for example, in pellet guns. The preferred launch velocity of projectiles 10 weighing from about 0.5 to about 1.0 grams is about 600 feet per second. To avoid breaking window glass at close range, the launch velocity for projectiles 10 should not exceed about 1000 feet per second. Where the use of projectile launching devices 42 having an outside configuration similar to that of a conventional firearm is deemed socially or politically undesirable, other configurations having an elongated tubular bore and any suitable mechanism for controlling the release of pressurized gas into the bore behind the projectile can likewise be used within the scope of the invention.

According to another method of the invention, fauna or flora situated in hard-to-reach or otherwise hazardous locations are contacted and treated for organisms such as pests, fungi and the like, with a control agent such as a pesticide, fungicide, herbicide or biocide by the use of a projectile as disclosed herein propelled by a gas-powered launching device from a remote location toward the intended use site.

Using system 40 and the methods of the invention, control agents 28 are successfully delivered and applied to target areas and targets at distances ranging from as little as about 1 to 3 feet, up to distances of about 45 feet or more from the user. The system and method of the invention are useful for treating areas that are dangerous or not otherwise accessible using known conventional applicator means for like agents.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A control agent delivery system comprising a projectile and a projectile launching device, the projectile launching device comprising a pressurized gas source communicating with a tubular barrel and the projectile comprising slidably engageable body and cap members made of a destructively deformable material, the body and cap members each further comprising an elongated, substantially cylindrical sidewall section having one closed, convex end and one open end, the open end of the body member being insertable inwardly of and in frictional engagement with the open end of the cap member, the projectile containing a control agent selected from the group consisting of pesticides, herbicides and fungicides in at least one of a liquid, gel or powder form, the projectile being selectively positionable inside the projectile launching device with the closed end of the cap member facing forwardly for treating a proximal area target or with the closed end of the body member facing forwardly for treating a distal target.

2. The control agent delivery system of claim 1 wherein the destructively deformable material is gelatin having a moisture content ranging from about 5 to about 20 weight percent moisture.

3. The control agent delivery system of claim 2 wherein the destructively deformable material is gelatin having a moisture content ranging from about 5 to about 15 weight percent.

4. The control agent delivery system of claim 1 wherein the destructively deformable material is gelatin having a moisture content of about 10 percent.

5. The control agent delivery system of claim 1 wherein the body and cap members are each made of grafted starch.

6. The control agent delivery system of claim 1 wherein the body and cap members are each made of a flexible, polymeric material.

7. The control agent delivery system of claim 1 wherein at least one of the body and cap members further comprises a distinguishing indicia.

8. The control agent delivery system of claim 7 wherein the distinguishing indicia is a colorant.

9. The control agent delivery system of claim 1 wherein the pressurized gas source comprises compressed carbon dioxide.

10. The control agent delivery system of claim 1 wherein the pressurized gas source comprises compressed gas selected from the group consisting of air, nitrogen, carbon dioxide, and mixtures thereof.

11. The control agent delivery system of claim 1 wherein the projectile further comprises at least one of a filler material or diluent.

12. The control agent delivery system of claim 11 wherein the filler material is selected from the group consisting of diatomaceous earth, fumed silica, cornstarch and mixtures thereof.

13. The control agent delivery system of claim 1 wherein the control agent is a pesticide selected from the group consisting of pyrethrin, piperonyl butoxide, permethrin, chlorpyrifos, propoxur, bacillus thuringiensis, hydromethylnon and fipronil.

14. The control agent delivery system of claim 1 wherein the control agent is a herbicide selected from the group consisting of bromacil, dicamba and glyphosate.

15. The control agent delivery system of claim 1 wherein the control agent is a fungicide selected from the group consisting of benomyl, cyproconazole and imazalil.

16. The control agent delivery system of claim 1 wherein the projectile comprises at least one pesticide and at least one pest attractant.

17. The control agent delivery system of claim 16 wherein the pest attractant is a feeding attractant.

18. The control agent delivery system of claim 16 wherein the pest attractant is a pheromone.

19. The control agent delivery system of claim 1 wherein the projectile has a length-to-diameter ratio ranging between about 1.58 and about 1.94.

20. The control agent delivery system of claim 1 wherein the projectile has a filled weight greater than about 0.35 grams.

21. The control agent delivery system of claim 20 wherein the projectile has a filled weight ranging from about 0.5 to about 1.0 grams.

* * * * *

UNITED STATES PATENT AND TRADEMARK OFFICE

CERTIFICATE OF CORRECTION

PATENT NO. : 6,675,789 B2 
DATED : January 13, 2004
INVENTOR(S) : Robert Clarence Pearce III and Dale Vilmer Kiplinger It is certified that error appears in the above-identified patent and that said Letters Patent is hereby corrected as shown below:

Title page,
Item [75], Inventors, replace "Carollton" with -- Carrollton --.
Item [74], *Attorney, Agent, or Firm*, replace "Rose" with -- Ross --.

Signed and Sealed this

Thirtieth Day of March, 2004

JON W. DUDAS
*Acting Director of the United States Patent and Trademark Office*